US008986178B2

(12) United States Patent
Klopman et al.

(10) Patent No.: US 8,986,178 B2
(45) Date of Patent: Mar. 24, 2015

(54) SLACKLINE APPARATUS AND TRAINING METHOD

(75) Inventors: James E. Klopman, Birmingham, AL (US); Robert C. Engle, Auburn, AL (US); Stacy Marable, II, Pike Road, AL (US); Matthew H. Kirk, Decatur, AL (US); De'Varus M. May, Argo, AL (US); Blake T. Hudson, Atlanta, GA (US); Christopher L. Kelley, Hoover, AL (US)

(73) Assignees: Auburn University, Auburn, AL (US); Slackbow LLC, Birmingham, AL (US)

( * ) Notice: Subject to any disclaimer, the term of this patent is extended or adjusted under 35 U.S.C. 154(b) by 500 days.

(21) Appl. No.: 13/297,543

(22) Filed: Nov. 16, 2011

(65) Prior Publication Data

US 2012/0238421 A1 Sep. 20, 2012

Related U.S. Application Data

(60) Provisional application No. 61/415,101, filed on Nov. 18, 2010.

(51) Int. Cl.

| | |
|---|---|
| ***A63B 26/00*** | (2006.01) |
| ***A63B 4/00*** | (2006.01) |
| ***A63B 7/08*** | (2006.01) |

(52) U.S. Cl.

CPC ..... *A63B 7/085* (2013.01); *A63B 2225/093* (2013.01)

USPC ..... 482/142; 482/34

(58) Field of Classification Search

USPC ..... 482/34, 142, 148, 23, 38, 39, 143, 908; 254/4 R, 4 B, 113, 120; 273/449; 269/17

See application file for complete search history.

(56) References Cited

U.S. PATENT DOCUMENTS

| | | | | |
|---|---|---|---|---|
| 254,215 | A | 2/1882 | Heeseler | |
| 1,128,201 | A * | 2/1915 | Wallin | 482/23 |
| 2,392,721 | A | 1/1946 | Burlin | |
| 3,083,964 | A | 4/1963 | Wentzel | |

(Continued)

FOREIGN PATENT DOCUMENTS

| | | | |
|---|---|---|---|
| DE | 202009006948 | U1 * | 8/2009 |
| DE | 202010003182 | U1 * | 6/2010 |

OTHER PUBLICATIONS http://firetoys.co.uk/juggling/Tightropes.html Feb. 15, 2009.*

(Continued)

*Primary Examiner* — Stephen Crow
*Assistant Examiner* — Nyca T Nguyen
(74) *Attorney, Agent, or Firm* — Gardner Groff Greenwald & Villanueva, PC

(57) ABSTRACT

A portable human balance training device for improving the human proprioceptive system, athletic performance, athletic speed, athletic agility, athletic vertical leap, athletic eye/hand coordination, spatial awareness, left/right brain organization and increasing the muscular development of a user. The balancing device has an elongated suspended support structure spanning the length of the device. The balancing device also has an end support structure at each end for suspending and stabilizing the support structure. A flexible line is mounted to the end supports and spans the length of the support structure. The user places all or part of their body weight on the suspended support band and attempts to balance.

23 Claims, 6 Drawing Sheets

(56) References Cited

U.S. PATENT DOCUMENTS

| | | | | |
|---|---|---|---|---|
| 3,570,848 | A * | 3/1971 | Bowen | 482/34 |
| 3,580,568 | A | 5/1971 | Stone | |
| 3,658,325 | A * | 4/1972 | Baker et al. | 482/34 |
| 3,754,757 | A * | 8/1973 | Bowen | 482/34 |
| 5,180,349 | A | 1/1993 | Marcus | |
| 5,616,102 | A | 4/1997 | Lahmann | |
| 2008/0312043 | A1 | 12/2008 | Cook | |

OTHER PUBLICATIONS

Libre Powersails, The Slackline-Frame, www.libre.de, pp. 1-2, (date unknown).

* cited by examiner

SLACKLINE APPARATUS AND TRAINING METHOD

CROSS-REFERENCE TO RELATED APPLICATION

This application claims the benefit of U.S. Provisional Patent Application Ser. No. 61/415,101, filed Nov. 18, 2010, the entirety of which is hereby incorporated herein by reference.

TECHNICAL FIELD

The present invention relates generally to the field of athletic equipment and training, human proprioceptive balance training, and more particularly to a mobile or portable slackline balancing and training device, and to training methods utilizing such a device.

BACKGROUND

Athletic training is an essential aspect to maintaining the physical conditioning, endurance, agility, strength and balance of a human or animal subject. Athletes may focus on a broad training regime or limit training to a particular area. In the field of balance training, and more particular dynamic balance training, a tensioned or slack line of webbing or rope mounted between two fixed points may be used as a training technique, commonly known as "slacklining." The two fixed points must support the ends of the slackline and bear the weight of the athlete and span a challenging length.

Previously known mobile or portable balancing equipment designs typically lack sufficient length and rope tension adjustability needed to provide a desired degree of muscular challenge, and limit the potential training techniques or training regimens enabled thereby. For example, the distance between the two end supports commonly limits the amount of slack that may be allowed in the line before the line bottoms out against the frame or contacts the ground. Less slack in the line makes balancing and training less challenging for the athlete and reduces the dynamics of the line. Additionally, the short span of the line or minimal distance between the two fixed support points of known devices reduces the dynamics of the line and thereby limits the challenge.

Outdoor training using trees or other stationary outdoor structures is often the best option to provide both a challenging span and degree of line slackness. But training outdoors is often seen as a drawback to balance training and is dependent upon the location of suitable supports and associated weather. Further, securing the suspended rope to trees can be damaging and potentially life threatening to living plants.

Thus it can be seen that needs exist for improved slackline training apparatus and methods. It is to the provision of an improved system and method for dynamic balance training meeting these and other needs that the present invention is primarily directed.

SUMMARY

In example embodiments, the present invention provides improved systems and methods for dynamic balance training. Example embodiments include a mobile balancing device for dynamic balance training. The mobile balancing device includes a suspended central beam member having a first end and a second end, a pair of symmetrical bow-like members mounted to the first and second ends of the suspended beam member, and a pair of end bracket assemblies mounting to the outer ends of the bow-like members and supporting the suspended beam member.

In one aspect, the present invention relates to a mobile or portable dynamic balancing system. The system preferably includes a canoe or bow-shaped frame structure having a central beam member and a pair of symmetrical radial or curved end beam members. The system preferably also includes a pair of end support structures for supporting the suspended beam members therebetween, each of the end supports having at least one mounting attachment for securing a line (such as a rope, cable, strap, cord or other flexible support member), wherein the structure supports a tensioned line bearing an applied load.

In another aspect, the invention relates to a method of assembling a mobile balancing device. The method preferably includes the steps of coupling the ends of first and second support arms to opposite ends of a central support beam, mounting first and second end supports to the outer ends of each support arm, mounting a flexible line to the first and second end support structure, and adjusting the degree of slackness or play in the flexible line.

In yet another aspect, the invention relates to a method of training on a dynamic balancing device. The method preferably includes the steps of adjusting the slackness and the height of a suspended line secured between the two end supports based on the skill level of the user, the user balancing on the suspended line while attempting an exercise or skill test comprising one or more positions or activities that are selected based on the skill level of the user, and balancing on the line while attempting one or more exercises to progressively increase the skill level, balance, and/or strength of the user.

In still another aspect, the invention relates to a training device. The training device preferably includes a central beam member having a first end and a second end, a pair of arcuate outer beam members, a pair of end bracket assemblies, and a flexible line. One arcuate outer beam member is preferably attached to the first end of the central beam member and the other is attached to the second end of the central beam member to form an elongate beam assembly. The end bracket assemblies support the elongate beam assembly therebetween and the flexible line extends between the bracket assemblies.

In yet another aspect, the invention relates to a training device. The training device preferably includes a pair of end supports having a base, an upright portion having a lower end attached to the base and an upper end extending away from the base, and an arm extending outwardly from the upright portion between the lower end and the upper end. A flexible line extends between the upright portions of the end supports proximal their upper ends and spans a length of at least ten feet, and a beam extends between the arms of the end supports.

In still another aspect, the invention relates to a method of training on a dynamic balancing device. The method preferably includes the steps of adjusting the tension and the height of a suspended line secured between the two end supports based on the skill level of the user. The user balances on the suspended line while attempting an exercise or skill test incorporating one or more positions or activities that are selected based on the skill level of the user. The position of the user's foot is varied between a first position aligned with the suspended line and a second position not aligned with the suspended line.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent about, will be understood that the particular value forms another embodiment.

Figures 1, 1A:
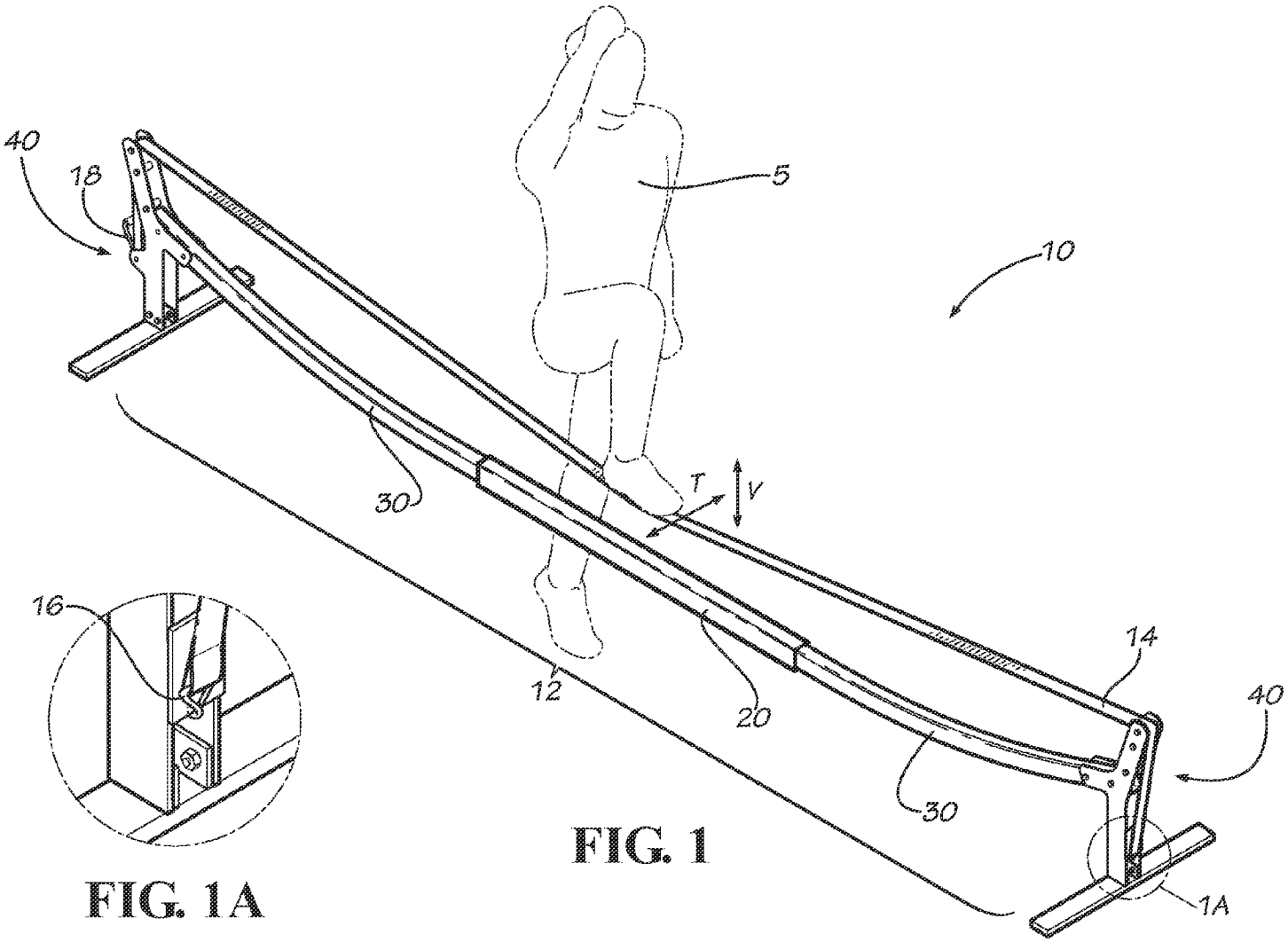
FIG. 1 is a perspective view of a training apparatus according to an example embodiment of the present invention and having an individual user thereon.
FIG. 1A is a detail view of a line coupled to one end of the training apparatus of FIG. 1.

With reference now to the drawing figures, wherein like reference numbers represent corresponding parts throughout the several views, FIG. 1 shows a portable or mobile balancing device 10 in use by an athlete or user 5. The balancing device 10 can be used to increase the muscular development of the athlete 5 by providing a dynamic suspended line or support band 14 that is fixed at two opposing points on the structure. The athlete 5 attempts to maintain balance by placing all or a part of their body on the dynamic suspended line, which can freely oscillate or move in the directions of a transverse axis T and a vertical axis V, which are mutually perpendicular to the lengthwise axis of the line 14. To gain and maintain balance or a steady state position, the user exercises multiple muscle groups. The dynamic suspended line can be adjusted to varying tensions that can alter the difficulty and rate of oscillation of the line and accommodate users of all skill levels.

In example embodiments, the mobile balancing device 10 comprises an elongated suspended support structure 12, a pair of end supports 40, and a suspended support band or line 14. The athlete 5 attempts to balance on the support band 14 while the elongated support structure 12 bears the stresses from the applied load of the user 5. In general, the elongated support structure 12 comprises a central suspended support beam 20 and a pair of symmetrical outer bow-like beam members 30. The end supports 40 elevate or suspend the elongated support structure 12 and anchor the ends of the suspended support band 14 that provides the user with a usable length L to train or balance (see FIG. 2).

Figure 3:
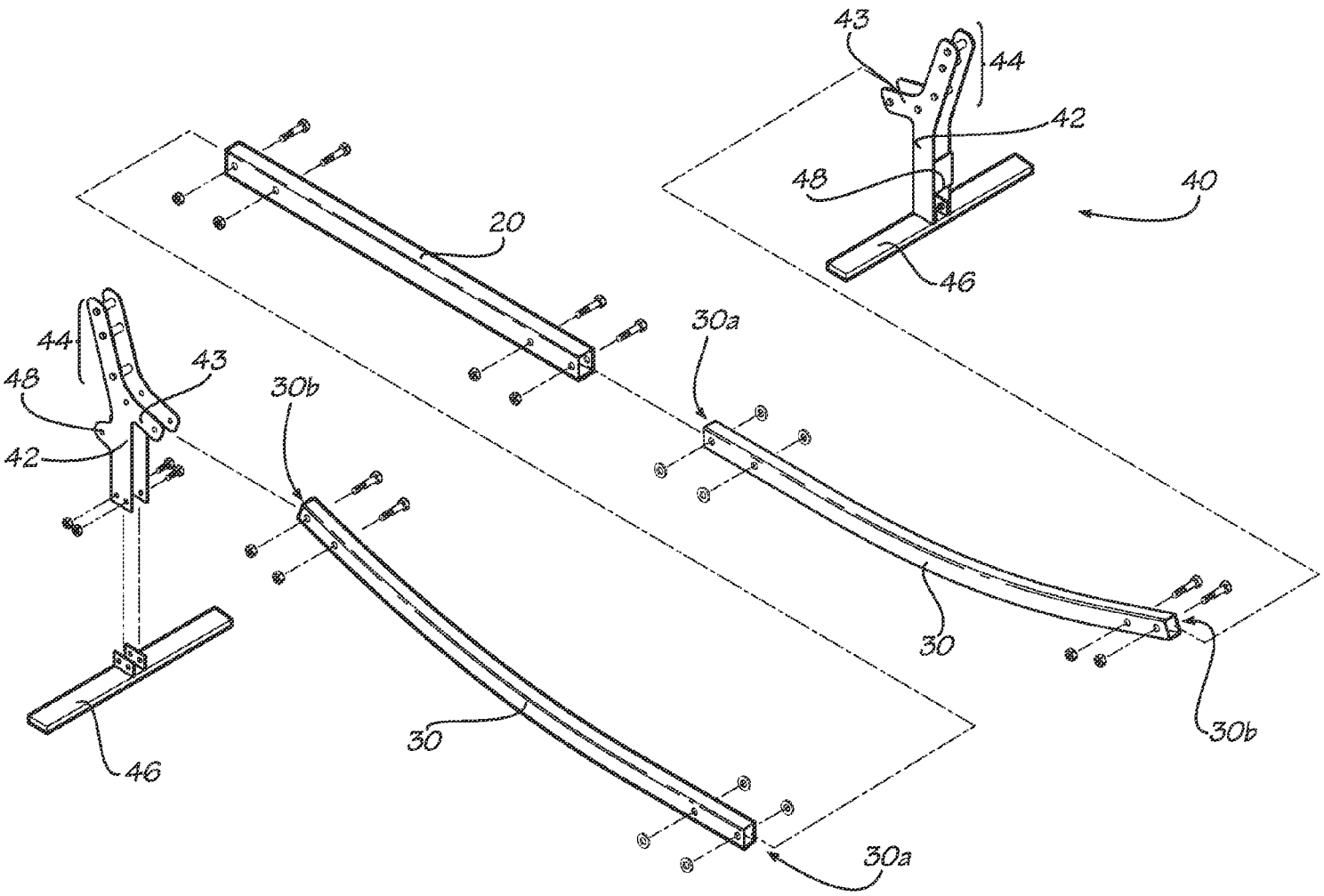
FIG. 3 is an assembly view of a training apparatus according to an example embodiment of the present invention.

The elongated suspended support structure 12 comprises one or more beam members. In depicted embodiments, a linear central support beam 20 is coupled between two outer beam members 30. A first or inner end 30*a* of each outer beam member is engaged with opposite ends of the central support beam 20. The outer beam members 30 are arcuate or curved, and the central support beam 20 is generally straight, resulting in a generally bow-like configuration of assembly 12. The central support beam 20 and the outer beam members 30 have substantially complementary rectangular cross-sections to allow the ends of the outer beam members to be slidingly received within an internal channel of the central support beam as depicted in FIG. 3. In alternate embodiments, ends of the central support beam are received within internal channels in the ends of the outer beam members. The beam members are attached to one another by bolts, screws, pins or other removable connectors, or by welding or other permanent connection means, to form the elongate assembly 12. In further embodiments, the internal channel at opposite ends of the central support beam 20 and/or the external surfaces of the outer beam members 30 comprise a block or welded stop limiting the extent to which the outer beam members may be inserted into the central support beam 20, thereby enabling the tension from the line 14 to maintain attachment of the elongate assembly 12 without the need for bolts or other connectors. In alternate embodiments, the central support beam 20 and the outer beam members 30 can comprise interengaging oval, elliptical, circular, square or non-symmetrical cross-sectional profiles. To increase vertical stiffness, the central support beam 20 and the outer beam members 30 are optionally oriented with a greater dimension in a vertical direction (beam height) and a lesser dimension in a horizontal direction (beam width).

Each of the end support structures 40 comprises a stability plate or base 46 for supporting the apparatus on the ground or other surface, and a symmetrical pair of upright plates 42 extending upwardly from the base. The base plate 46 extends outwardly, transverse to the lengthwise axis of the line 14, a sufficient distance to provide stability and prevent tipping during use. Each of the upright plates 42 has an arm 43 extending obliquely outward therefrom. The upright plates 42 are spaced a distance from one another to permit engagement of the outer ends of the outer beam members 30 between the arms 43 of the plates. One or more bolts, screws, pins or other connectors secure the outer beam members 30 to the end support structures 40 through cooperatively positioned holes in the outer beam members 30 and in the arms 43 of the upright plates. The arms 43 of the upright plates are positioned at a height above the base 46 sufficient to maintain the beam structure 12 suspended a distance above the ground level when loaded.

A plurality of mounting pins 44 extend between the upright plates 42 at different elevations to allow adjustment of the height of the line 14. Alternatively, a single repositionable mounting pin can be selectively positioned in one of a plurality of receiver openings to allow height adjustment. A line securing pin 48 or other attachment means is attached to or integral with the end support structure 40 for attachment of the suspended support band or line 14. The suspended support band or line 14 comprises a length of rope, nylon webbing, cable, strap, cord or other flexible support material having sufficient strength to carry the weight of an anticipated user. In example embodiments, the line 14 comprises a 1"-3" inch woven nylon, polyester or polypropylene web with at least a 2,000 pound load rating. In alternate embodiments, the line comprises one or more other forms of strap, cable, rope, belt and/or other flexible member(s). A loop or hook 16 is provided at each end of the line 14 to affix to the securing pins 48 (see FIG. 1A). The line 14 is preferably long enough to span from one end of the apparatus to the other and allow sufficient slack or play when loaded to provide varying degrees of training difficulty. A line tensioning or adjustment device 18 can be provided for selectively adjusting the length and/or tension of the line 14. Various adjustment means can be utilized, for example, a ratcheting hand winch or crank, a repositionable attachment member, an eccentric pulley, length adjustment clamps, or other means may be provided. The tensioning/adjustment device 18 can be integral to the support band 14 or may be attached to the frame or elsewhere on the device, for example by fixing a tensioning device to one or both of the end support structures 40.

The height of the end support structures 40 combined with the downward curvature of the bow-shaped beam assembly 12 away from the line 14 allows adjustment of the line length and/or tension to provide sufficient slackness to the line without the line "bottoming out" on the ground or the beam, and thereby maximize the usable length L of the line. In example embodiments, a vertical spacing H of about twelve inches between the center or trough of the bow-shaped beam assembly 12 and the uppermost line elevation (see FIG. 1) is provided for a line 14 spanning a horizontal length L (see FIG. 2) of about fourteen feet (H/L=0.071). Further example embodiments provide ratios of vertical spacing to horizontal line span (H:L) of between about 8":10' (H/L=0.0667) to about 18":20' (H/L=0.075); or H/L of between about 0.05 to about 0.09, or between about 0.06 to about 0.08, or approximately 0.07.

The "leaf spring" or bow shape of the support structure 12 withstands the bending moment caused by the user 5 placing all or part of their body weight on the suspended support band or line 14. The curvature of the outer beam members 30 distributes the stresses evenly along their length. The central support beam 20 preferably has a larger and/or stiffer construction than the outer beam members, and bears the bending moment where the maximum stresses occur when loaded. As depicted in FIG. 2A, in example embodiments, the central beam member 20 has a vertical dimension or height $h_1$ greater than the vertical dimension or height $h_2$ of the outer beam members 30. In alternate embodiments, the stiffness of the central support beam 20 is greater than the stiffness of the outer beam members 30 due to increased material thickness of the beam flanges or webs, by forming the central support beam of a solid bar of material and the outer beam members of channel or tube stock, and/or otherwise providing the central support beam with a greater moment of inertia than the outer beam members.

When a load is applied to the support band or line 14, the support structure 12 acts as a spring and elastically deforms. The elastic deformation of the support structure 12 causes the central suspended support beam 20 to move away from the loaded suspended support band 14 and causes the bases 46 to move in an opposing outward direction. Accordingly, the support structure 12 movement provides additional clearance for the loaded suspended band 14 and the outward movement of the bases 46 allows the support structure to flex under load. The bases 46 may alternatively be provided with low-friction or high friction pads or contacts to either increase or decrease the resistance to movement of the apparatus along the support surface.

In example embodiments, the line height H, tension, and resulting oscillation of the suspended support band or line 14 are adjustable to accommodate a wide variety of skill levels among different users, or the increasing skill level of an individual user as he or she practices. For example, an experienced athlete may require a very loose suspended support band 14 having substantial amounts of oscillation to obtain a satisfactory workout, while a beginner athlete is likely to require a greater amount of line tension with smaller amounts of oscillation. To accommodate both the experienced athlete and the beginner athlete, the height H can be varied by the placement of the suspended support band 14 on different mounting pins 44. For the experienced athlete using a slacker line tension (and thus more sag and/or lateral play in the line when loaded), a greater height H is provided by selecting a higher pair of mounting pins 44 to carry the band 14 to ensure the suspended support band will maintain clearance from the support structure 12 and not bottom out (as shown in solid lines in FIG. 2). For the beginner athlete using a tighter line tension (with less sag), a lower height H is provided by selecting a lower pair of mounting pins 44 to provide a safer falling distance (as shown in broken lines in FIG. 2).

Figure 4:
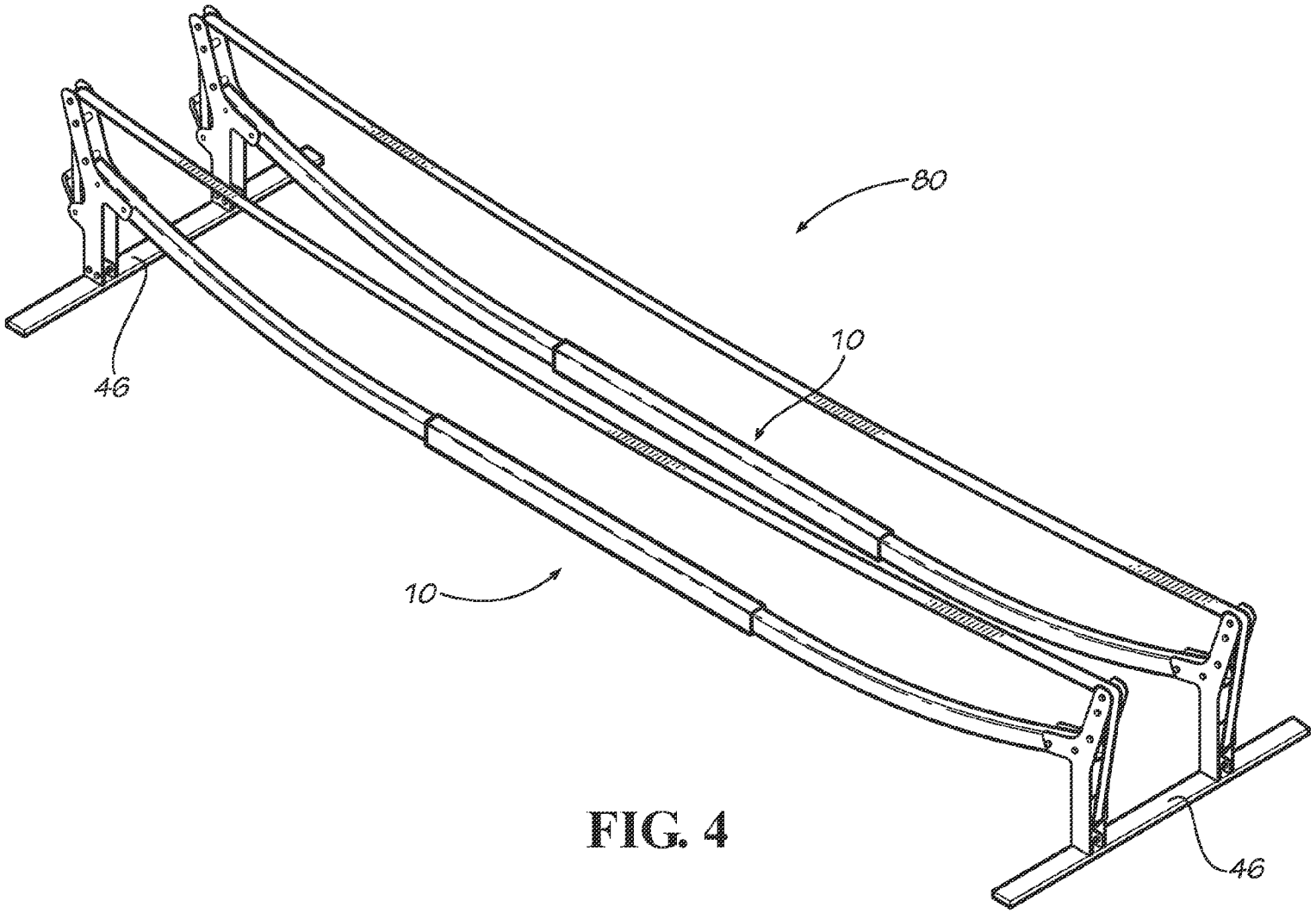
FIG. 4 is a perspective view of a training apparatus according to another example embodiment of the present invention.

FIG. 4 shows an alternate embodiment comprising a two-line balancing device 80. The two-line balancing device comprises two balancing devices substantially as described above, mounted to the same stability bases 46 in a spaced apart configuration. Preferably the spacing between the two balancing devices replicates the shoulder width of the athlete that intends to use the two-line device 80. In alternate forms, the spacing between the two lines may be adjustable, for example by selective repositioning and attachment of the uprights on the bases. The two-line device 80 allows athletes to train in an "athletic position" with a foot on each suspended support band 14. Additionally, the two-line device provides an easier alternative for beginner athletes.

In example forms, the mobile balancing device 10 is fastened together with threaded bolts and nuts, or other removable fasteners, to allow disassembly and easier storage or portability. In further embodiments, the fasteners can include pins, hinges, brackets, welds, or other fasteners of the like. In particular embodiments, the threaded bolts are a button head socket cap style. In an example method of assembly, the mobile balancing device 10 is assembled using two bolts for each point of connection. The second end 30*b* of each outer beam member is secured to each arm 43 of the end support structure 40. The first end 30*a* of each outer beam member is slidably engaged and secured within each end of the central support beam 20 internal channel. Depending upon the desired height, the line is placed on the top of the appropriate end support structure mounting pin and affixed to the securing pins. The ratcheting hand winch is operated to tension the line to provide a desired slackness.

Figure 5A:
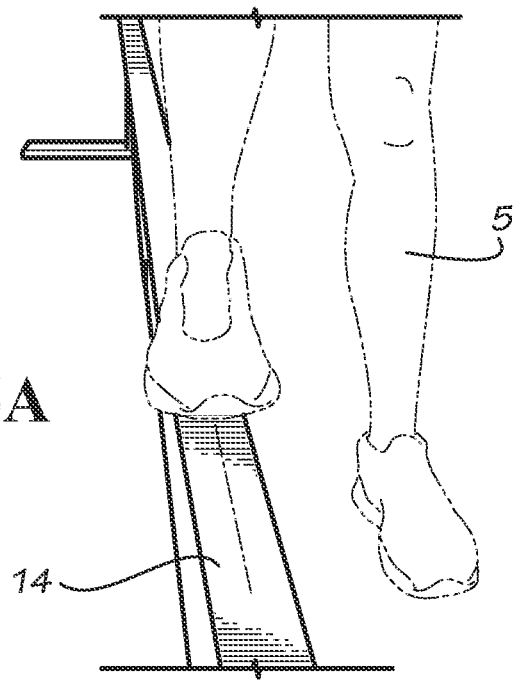
FIG. 5A is a perspective view of a user in a parallel foot position on a training apparatus according to an example of the present invention.
Figure 5B:
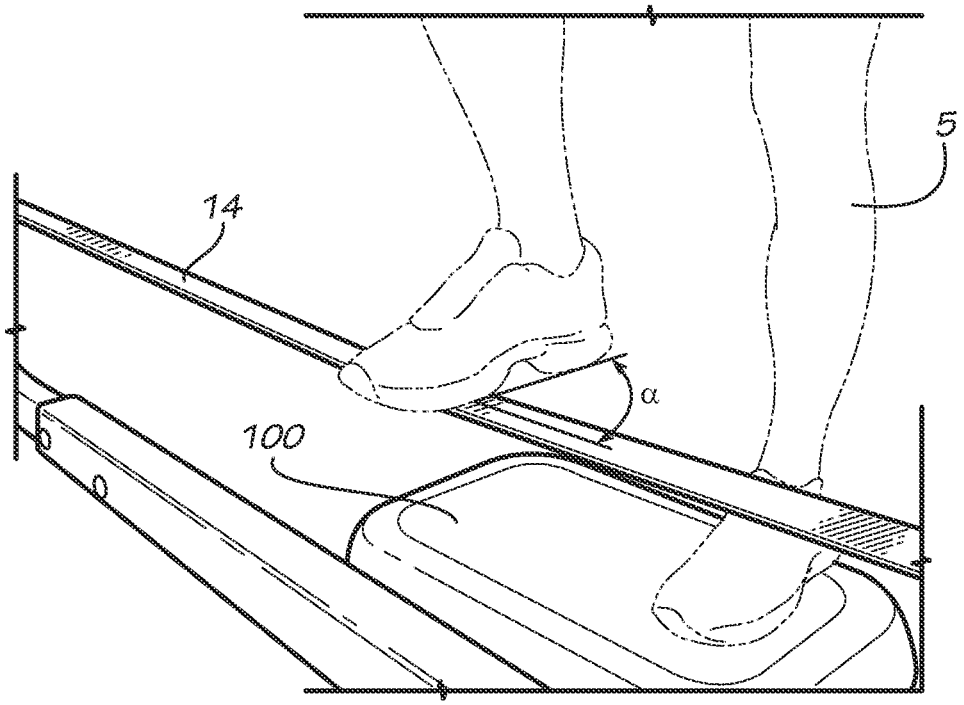
FIG. 5B is a perspective view of a user on a training apparatus in a perpendicular foot position according to another example of the present invention.
Figure 5C:
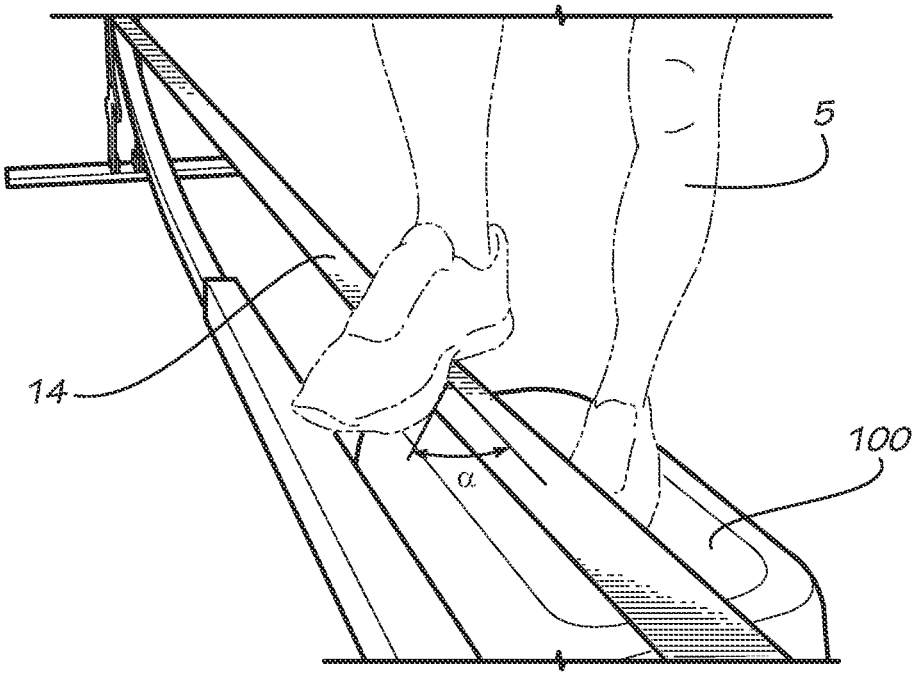
FIG. 5C is a perspective view of a user on a training apparatus in an angled foot position according to another example method of use of the present invention

In an example method of use, the above described apparatus enables a training regimen to develop and progressively increase the strength, skill level and/or balance of the user. The training regimen optionally comprises one or more of four separate protocols varying upon the skill level (beginner, intermediate, advanced, and expert). Each protocol comprises instructions for the appropriate height H and tension of the suspended support band 14, a skill test to determine the current skill level of the user 5, and one or more training activities or exercises. Accordingly, as the skill level of the athlete improves, the vertical elevation or distance H in line height is increased and the line tension is decreased. Additionally, a stepping box 100 can optionally be placed alongside the suspended support structure to reduce the distance between the suspended support band 14 and the ground (see FIGS. 5B-C).

Figure 2:
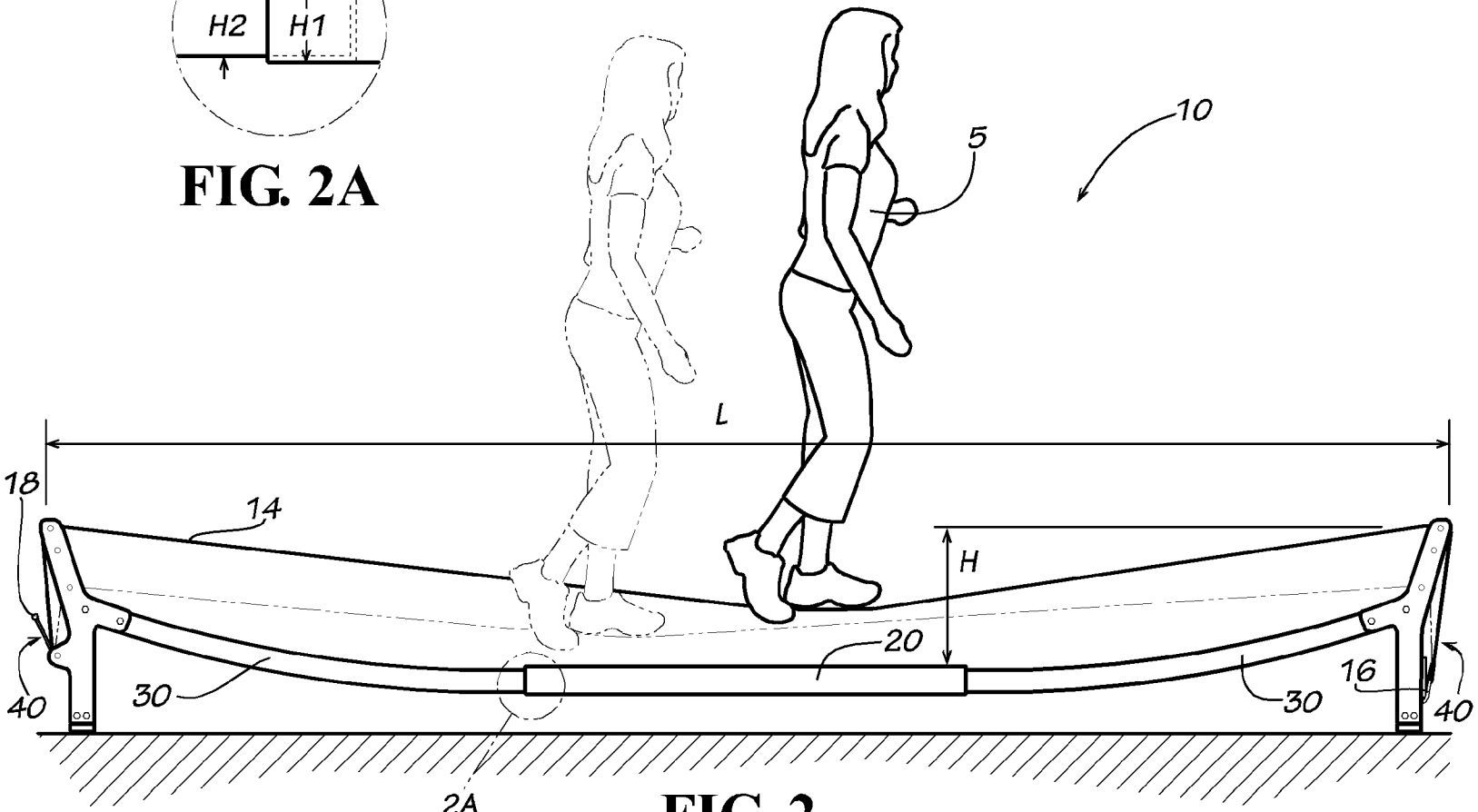
FIG. 2 is a side view of a training apparatus according to an example embodiment of the present invention and having an individual user thereon.
Figure 2A:
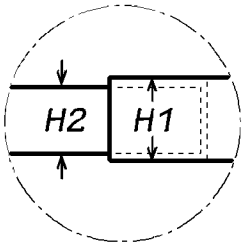
FIG. 2A is a detail view of the coupling point between a central suspended beam member and an interconnected outer bow or beam member of the apparatus of FIG. 2.

FIG. 2 shows a proper body position or athletic stance of a user with flexed knees, a slight bend at the hips, head up, back straight, and shoulders loose. Each of the four training protocols recommends the user to balance on the line in one or more foot directions: a parallel foot direction, foot parallel to line. (see FIG. 5A); a perpendicular foot direction, foot perpendicular to line (see FIG. 5B); and an angled foot direction, foot preferably at a 45 degree angle from perpendicular (see FIG. 5C). Without being bound by theory, the three foot positions are believed to train each of the three main human balance systems, left/right or side to side balance challenge when there is a sideways force on the body, the balance force is on a foot that is parallel to the body; as well as a front to back or a stopping balance challenge, where the forces of slowing down or stopping from forward movement, whether walking or running and the balance force thrust the body forward and the balance force is forward and back on the front of the foot; and the angle or 45 degree balance challenge where the body when the body is turning as in running and changing direction or rotating through an athletic activity such as throwing a ball, hitting a golf ball or throwing a punch.

Beginner Training Protocol

In an example method of use, a user or athlete follows the beginner training protocol. A strap is preferably attached to both sides at the lowest height upright pin and tensioned tightly. The athlete stands with one foot on the tensioned strap and the other on the floor or stepping box. The athlete gently pushes off of the toe of the foot on the ground and applies their full body weight to the foot that is placed on the strap (see FIG. 1). The athlete attempts to balance on the strap ten times in each of the three foot directions (parallel, perpendicular, and 45 degrees) using the left and the right foot. The athlete completes/masters the exercise when balance can be maintained in any of the three directions for at least ten seconds.

Intermediate Training Protocol

In another example method of use, a user or athlete follows the intermediate training protocol. A strap is preferably attached to both sides of the middle height upright pin and tensioned tightly. The athlete stands with one foot on the tensioned strap and the other on the floor. The athlete gently pushes off of the toe of the foot on the ground and applies their full body weight to the foot that is placed on the strap. The athlete attempts to balance on the strap in each of the three foot directions (parallel, perpendicular, and 45 degrees) using each foot for two minutes. The athlete completes/masters the exercise when balance can be maintained for at least ten seconds in all three foot directions.

Advanced Training Protocol

In another example method of use, a user or athlete follows the advanced training protocol. A strap is preferably attached to both sides of the highest height upright pin and tensioned tightly. The athlete stands with one foot on the tensioned strap and the other on the floor. The athlete gently pushes off of the toe of the foot on the ground and applies their full body weight to the foot that is placed on the strap. The athlete attempts to balance on the strap in each of the three foot directions (parallel, perpendicular, and 45 degrees) using each foot for one minute. The athlete attempts to walk slowly and controlled on the strap for three minutes, wherein a completed walk is five deliberate, slow, controlled steps. Additionally, the athlete holds an appropriately weighted dumbbell or weight in each hand, preferably arms bent and hands at ear level, and attempts to balance on the strap in the parallel foot direction using each foot for one minute intervals. Further, to add perturbation to the balance challenge the athlete attempts to balance on the strap in the parallel foot direction while bending their knee or squatting. The athlete completes/masters the exercise when balance can be maintained for at least twenty seconds in all three foot directions.

Expert Training Protocol

In an example method of use, a user or athlete follows the expert training protocol. A strap is preferably attached to both sides of the highest height upright pin and tensioned loosely. The athlete stands with one foot on the tensioned strap and the other on the floor. The athlete gently pushes off of the toe of the foot on the ground and applies their full body weight to the foot that is placed on the strap. The athlete attempts to balance on the strap in each of the three foot directions (parallel, perpendicular, and 45 degrees) using each foot for one minute. The athlete attempts to balance on the strap while squatting for thirty seconds in each of the three foot directions. The athlete attempts to balance on the strap while holding a weight in each hand, preferably arms bent and hands at ear level, for thirty seconds in all three foot directions. For three minutes, the athlete attempts multiple five step walks on the strap and maintains balance on the strap when turning around. Additionally, the athlete attempts to balance on the strap using both feet for two minutes in both perpendicular and 45 degree foot directions. The athlete completes/masters the exercise when balance can be maintained while walking five steps, squat and hold for ten seconds, holding weights in any foot direction for twenty seconds.

In continuation of the expert training protocol, the athlete optionally completes one or more additional training activities to add further perturbations and challenges, such as: (1) The athlete attempts to balance on the strap for one minute in each of the three directions while catching and throwing a weighted ball; (2) The athlete attempts to balance on the strap for two minutes in each of the three foot directions while switching a weight with handle or kettlebell from hand to hand; (3) The athlete attempts to balance on the strap in each of the three foot directions while supporting a weighted/sand bag above the shoulders or by the arms. Additionally, other stabilizing exercises can be performed while using the apparatus. For performing an arm press exercise, the athlete sits on the strap and places the palm of the hands on the strap with fingers facing forward. The athlete presses into the line, straightening the elbows, and lifting the entire body. For performing a push up exercise, the athlete places the palm of the hands on the strap and straightens the legs while keeping the feet in contact with the ground. The athlete presses into the line, straightening the elbows, and lifting the entire upper body. For performing a plank exercise, the athlete places one or two palms on the strap and one or two feet on the strap. Without the core body touching the strap, the athlete attempts to maintain balance.

The balancing device 10 can be constructed of steel, aluminum, composites (i.e carbon fiber or fiber glass), plastics, other known materials or combination herein. As each material has specific material properties, the physical behavior or flexure of the device 10 may vary from one material to the other, resulting in different beam geometries. For example, carbon fiber may allow a minimum vertical distance H of 8 inches to prevent bottoming out versus a twelve inch vertical distance H for a structurally similar embodiment constructed of steel.

While the invention has been described with reference to preferred and example embodiments, it will be understood by those skilled in the art that a variety of modifications, additions and deletions are within the scope of the invention, as defined by the following claims.

What is claimed is:

1. A training device comprising:

a central beam member, the central beam member having a first end and a second end;

a pair of arcuate outer beam members, one attached to the first end of the central beam member and the other attached to the second end of the central beam member to form an elongate bow-shaped beam assembly; and a pair of end bracket assemblies supporting the elongate beam assembly therebetween; and a flexible line extending between the pair of end bracket assemblies configured for a user to perform balance training thereon, wherein each of the end bracket assemblies comprise a plurality of mounting positions for carrying the flexible line such that a vertical distance, measured between the points of engagement of the flexible line to the mounting positions and the central beam member, is adjustable between a plurality of different height settings, each of the plurality of different height settings corresponding to a respective one of the plurality of mounting positions.

2. The training device of claim 1, wherein a tension of the flexible line is adjustable.

3. The training device of claim 2, wherein the plurality of mounting positions combined with the bow-shaped beam assembly allows for adjustment to the flexible line length and/or tension to provide sufficient slackness to the flexible line without the flexible line bottoming out on the beam due to a force being applied thereto by a user and causing the beam to flex away from the line.

4. The training device of claim 1, further comprising a second pair of end bracket assemblies carrying a second flexible line.

5. The training device of claim 4, wherein the second pair of end bracket assemblies are coupled to opposite ends of a second beam structure comprising a second central beam member and a second pair of outer beam members.

6. The training device of claim 1, wherein a ratio of vertical spacing H between the central beam member and the point of attachment of the flexible line to the end bracket assemblies to horizontal length L of span of the flexible line (H/L) is between 0.05 to 0.09.

7. The training device of claim 6, wherein the H/L ratio is between 0.06 to 0.08.

8. The training device of claim 6, wherein the H/L ratio is approximately 0.07.

9. The training device of claim 1, wherein the central beam member has a greater moment of inertia than the outer beam members.

10. The training device of claim 1, wherein the flexible line spans a horizontal length of at least 9 feet.

11. The training device of claim 1, wherein the vertical distance between the central beam member and the point of attachment of the flexible line to the mounting positions is at least 8 inches.

12. The training device of claim 1, wherein ends of the outer beam members extend into an internal channel of the central beam member.

13. The training device of claim 1, wherein the arcuate outer beam members generally extend oppositely and axially from the first and second ends of the central beam member.

14. The training device of claim 1, wherein the elongate beam assembly is generally curved.

15. A training device comprising:

a pair of end supports, each end support comprising a base, an upright portion having a lower end attached to the base and an upper end extending away from the base, and an arm extending outwardly from the upright portion between the lower end and the upper end;

a flexible line extending between the upright portions of the end supports proximal their upper ends thereof wherein the flexible line is configured for a user to perform balance training thereon; and a bow-shaped beam extending between the arms of the end supports, wherein a plurality of corresponding mounting members are provided at different distances from the upper ends of the upright portions of each end support, and wherein the flexible line is selectively engageable with corresponding pairs of the plurality of corresponding mounting members to adjust a height of the flexible line.

16. The training device of claim 15, wherein the beam is bow-shaped and curves away from the flexible line.

17. The training device of claim 16, wherein the curvature of the bow-shaped beam defines a vertical distance between the beam and points of connection of the flexible line to the end supports of at least 8 inches.

18. The training device of claim 15, wherein the beam comprises a central beam member and a pair of outer beam members.

19. The training device of claim 18, wherein the central beam member has an internal channel extending at least partially therethrough, and wherein ends of the outer beam members extend into the internal channel of the central beam member.

20. The training device of claim 15, further comprising a second pair of end supports carrying a second flexible line.

21. The training device of claim 20, further comprising a second beam extending between the second pair of end supports.

22. The training device of claim 15, wherein the flexible line spans a length of at least 10 feet.

23. The training device of claim 15, wherein the tension of the flexible line is adjustable.

* * * * *